US005411189A

United States Patent [19]

Gouldson

[11] Patent Number: 5,411,189

[45] Date of Patent: May 2, 1995

[54] GARMENT HANGER

[75] Inventor: Stanley Gouldson, Northport, N.Y.

[73] Assignee: Spotless Plastics Pty. Ltd., Moorabbin, Australia

[21] Appl. No.: 121,998

[22] Filed: Sep. 14, 1993

[51] Int. Cl.[6] ..... A47G 25/48

[52] U.S. Cl. ..... 223/85; 223/91

[58] Field of Search ..... 223/85, 91, 92, 93, 223/95, 96; D6/326, 315

[56] References Cited

U.S. PATENT DOCUMENTS

| | | | |
|---|---|---|---|
| D. 246,817 | 1/1978 | Mainetti . | |
| 2,171,680 | 9/1939 | Baugh | 223/96 |
| 3,463,369 | 3/1967 | Moskowitz . | |
| 4,623,079 | 11/1986 | Tendrup et al. | 223/85 |
| 4,629,102 | 12/1986 | Tendrup et al. | 223/85 |
| 4,714,183 | 12/1987 | Tontarelli | 223/91 |
| 4,828,155 | 5/1989 | Louw . | |
| 4,892,237 | 1/1990 | Duester et al. . | |
| 4,951,855 | 8/1990 | Jacobson et al. . | |
| 5,002,210 | 3/1991 | Kolton et al. . | |
| 5,062,556 | 11/1991 | Willputz . | |
| 5,065,916 | 11/1991 | Fildan . | |
| 5,127,559 | 7/1992 | Freer et al. | 223/85 |
| 5,129,557 | 7/1992 | Kolton et al. . | |
| 5,236,109 | 8/1993 | Zuckerman . | |

*Primary Examiner*—Clifford D. Crowder
*Assistant Examiner*—Bibhu Mohanty
*Attorney, Agent, or Firm*—Scully, Scott, Murphy & Presser

[57] ABSTRACT

A multi-garment, re-usable plastic hanger having a clip configuration wherein a recess is formed in a web connecting a first garment retaining clip and a second garment retaining clip to a longitudinally extending body of the hanger to provide spring action which accommodates the stress placed on the web without breaking.

6 Claims, 3 Drawing Sheets

GARMENT HANGER

FIELD OF THE INVENTION

The present invention is directed to the field of molded, plastic garment hangers.

BACKGROUND OF THE INVENTION

Molded plastic garment hangers are widely used for the purpose of shipping and displaying garments. Garment hangers of that type may either be simply constructed as molded plastic structures incorporating a unitary or metal central hook adapted to be suspended from a suitable support, such as a garment rack or the like, or with a hanger body portion having arms extending in opposite directions from the base of the hook portion so as to facilitate a garment to be suspended therefrom. When needed for specific use, the opposite or distal ends of the body portion or arms may be members to enable the attachment of various kinds of garments thereto, such as underwear, slips, brassieres, swimwear, multiple garments, and the like.

A wide variety of such garment hangers are presently known. Typically, such garment hangers have a hook portion elevated above a horizontally-extending body portion, as shown in U.S. Pat. Nos. 4,828,155; 3,463,369; and U.S. Pat. No. Des. 246,817. In order to grasp a garment effectively, clips, grips, slots or hooks (collectively referred to herein as "clips") are placed at the ends of the body portion of the hanger. Such prior art hangers are exemplified by U.S. Pat. Nos. 4,623,079; 4,629,102; 4,892,237; 5,065,916; and 5,129,557.

U.S. Pat. Nos. 4,623,079 and 4,629,102 disclose a hanger having an elevated hook member, a hanger body having horizontally extending arms and, respectively, resilient grips and clips of a U-shaped configuration located at the end of each arm. The U-shaped configuration includes first and second members, which are connected to each other; the second member also being connected to the hanger body. The U-shaped garment engaging grip or clip has a double-flex mechanism to prevent breakage of the grip or clip when a garment is resiliently engaged.

U.S. Pat. No. 4,892,237 discloses a plastic garment hanger having a hook, a body bar extending longitudinally from said hook, said body bar terminating at each end in a pair of arms, one above and one below the body bar, which form garment receiving slots. A third arm creates a downwardly opening slot at the end of the body. The shape of the arms is such that the mouth or open end of the slot is narrower than the upper or inner end of each clip. Adjacent the blind end of the garment receiving slot, the slot is deepened to form a pocket which is recessed downwardly into the body. At the entrance of the pocket a tongue from the upper flange of the body bar is provided. The tongue divides the pocket. Additionally, a finger which extends upwardly and outwardly at an angle from the upper flange of the body bar is provided. The finger is spaced inwardly a short distance from the clip.

U.S. Pat. No. 5,065,916 discloses a plastic garment hanger having garment retaining clip ends formed with downwardly and outwardly included support elements from which upper and lower retaining elements extend in a "T" and are provided directly with the formations engaging the garments in respective channels. The channels are defined by surfaces having interdigitating arrays of teeth. The clip configuration is intended to overcome the deficiencies ordinarily associated with clips having flexible bent back fingers.

U.S. Pat. No. 5,129,557 discloses a plastic garment hanger having a hook, a body bar extending longitudinally from the hook and wing portions terminating each end of the body bar. Each wing portion defines a first channel extending upwardly. The body bar defines a second channel in intersecting relation with the first channel. The second channel is inclined at an acute angle with respect to the first channel. Positioned along the first channel are a series of generally semi-circular projections which function to impede the movement of the garment, i.e., panty, intended to be suspended therefrom.

U.S. Pat. No. 5,236,109 discloses a plastic, multi-garment hanger which includes a slot extending upwardly from the edge of the body member between a vertically oriented clip and a horizontally oriented clip. The slot provides for the displacement of a portion of the vertically oriented clip and/or the horizontally oriented clip thereby reducing the level of stress concentrated at the upper, inward edge of vertical oriented clips and the connecting portion of the horizontally oriented clips of typical multi-clip hangers. However, while the slot is taught to provide additional flexibility, applicant notes that the portions of the vertically oriented and horizontally oriented clips of U.S. Pat. No. 5,236,109 are necessarily thinner in construction which weakens such clips and reduces their strength.

Each of the above-described prior art hangers (with the exception of the hanger provided by U.S. Pat. No. 5,129,557) is provided with a clip arrangement for the retention of light-weight, two-piece garments, such as panties and brassieres. Each type of clip arrangement is provided with some level of flexibility necessary for the insertion of the garment in the clip.

The clip arrangement of the hanger disclosed in U.S. Pat. Nos. 4,623,079 and 4,629,102, described above, has generally a U-shaped configuration, the flexible free end of which can be deflected in two directions.

The clip arrangement of the hanger disclosed in U.S. Pat. No. 5,065,916, described above, has a T-shaped clip configuration to firmly engage garments. It will be appreciated that the channel of the vertical clip extends at its upper end into an inwardly extending lateral slot so that a bend is applied to the waistband which can be somewhat stretched to better secure the waistband.

The clip arrangement of the hanger disclosed in U.S. Pat. No. 4,892,237, described above, is designed so that the flexible arms forming the garment receiving channels provide a clamping zone to prevent the inadvertent release of the garment retained therein.

However, a combination of different types of clothing are not easily positioned on or removed from these hangers. Since many of the clip arrangements of the prior art hangers are not constructed to flex numerous times without breaking and provide sufficient resistance to deflection at the time the garments are suspended therefrom and/or are removed. Additionally, these hangers do not effectively clamp a combination of different types of clothing especially garments which have very thin straps and thick waistbands.

SUMMARY OF INVENTION

Accordingly, it is an object of the present invention to provide a garment hanger which avoids the disadvantages of the prior art.

The present invention is directed to a light-weight, one-piece, molded, plastic garment hanger that is particularly adapted for high volume injection molding and, further, can be utilized to suspend a combination of different types of garments, including garments with very thin, flimsy straps and very thick (or thin) waistbands, at the same time.

More particularly, the hanger of the present invention comprises: a hook member; a body member extending longitudinally from the hook member, wherein the body member defines first and second ends; a garment retaining member integrally molded with the body member at each of the first and second ends, wherein the garment retaining member comprises at least a first garment retaining clip, a second garment retaining clip, and a pocket.

In a preferred form of the invention, the first garment retaining clip is positioned adjacent to the body member and defines a first garment receiving channel therebetween. The first garment retaining clip has a substantially U-shaped configuration comprising a first member and a second member integrally connected in spaced relation at a connecting portion, whereby the second member deflects into a deflecting area defined by the first member, the second member and the connecting portion. The connecting portion may be formed with a rounded lip that extends upwardly and inwardly toward the hook member. The lip facilitates the insertion of a garment to be suspended from the hanger.

The pocket of the hanger of the present invention is open along an upper portion to the first garment receiving channel and is defined by the body member on a bottom portion and a first side portion, and a web integrally connected to the body member on a second side portion.

The second garment retaining clip extends from a top portion of the web in a substantially U-shaped configuration including a deflecting leg. The deflecting leg has an uppermost portion having a substantially triangular configuration. The web and the deflecting leg define a second garment receiving channel therebetween, wherein the deflecting leg and the web are each formed with a series of complementary rippled protrusions.

The triangular uppermost portion of the deflecting leg begins at or near the center longitudinal axis of the body member, wherein a first side is parallel to the body member and a second side is angled downwardly at an acute angle so that a bend is applied to the waistband over the center of the longitudinal axis of the hanger to better secure the waistband and resist against deflection of the ends due to the stretching forces applied to the ends of the hanger by the waistband.

In a particularly preferred form of the present invention the second side portion of the pocket defines a recess in the web. The recess extends into the web and provides added flexibility to the first and second garment retaining clips by reducing the amount of stress ordinarily concentrated at an upper edge of the second garment retaining clip and the outer edge of the first garment retaining clip.

In another embodiment the hanger of the present invention may be molded with a finger projection positioned on the body member closer to the hook member. The finger projection extends upwardly and outwardly to prevent the strap from inadvertent disengagement with the first garment retaining clip.

In still another embodiment the hanger of the present invention may be molded with a lower portion of the web which is formed with an downwardly and inwardly extending rounded lip to facilitate the insertion and removal of garments to be suspended from said second garment retaining clip.

In yet another embodiment the pocket of the hanger of the present invention may extend beyond the first garment receiving channel into the web such that the web defines a segment of the upper portion.

By molding the garment hanger in the above form, a light-weight garment hanger especially suitable for suspending a combination of different types of clothing is provided. The clip arrangement is especially suitable for clothing combinations, such as a two-piece bathing suit or a bra and panty set. Bras typically have thin, flimsy straps for which the first garment retaining (horizontal) clip is particularly suitable. The configuration of the horizontal clips is especially suitable for the insertion of either thick or thin straps. The configuration of the vertical clip is especially suitable for the insertion of garments having either thick or thin waistbands.

The members and legs of the garment retaining clips of the present invention are particularly constructed to flex numerous times without danger of breakage but still provide sufficient resistance to deflection that would result in release of the garment clamped therein.

Accordingly, it is a basic object of the present invention to provide an inexpensive, aesthetically pleasing, reusable, light-weight, molded plastic garment hanger from which a combination of different clothing types may be suspended, including brassieres having either thin or thick straps and panties having either thick or thin waistbands.

It is a further object of the present invention to provide a light-weight, molded, plastic garment hanger which operates in a manner that permits easy and convenient suspension, arrangement and removal of a garment to be suspended therefrom.

BRIEF DESCRIPTION OF DRAWINGS

The foregoing and other objects of the invention may now be more readily ascertained from the following detailed description of the preferred embodiments thereof, taken in conjunction with the accompanying drawings, in which.

DETAILED DESCRIPTION OF INVENTION

FIGS. 1–7 illustrate a garment hanger of the present invention. While the invention will be described and illustrated with respect to intimate apparel hangers, it is understood that the invention is equally applicable to other types of garment hangers.

Figure 1:
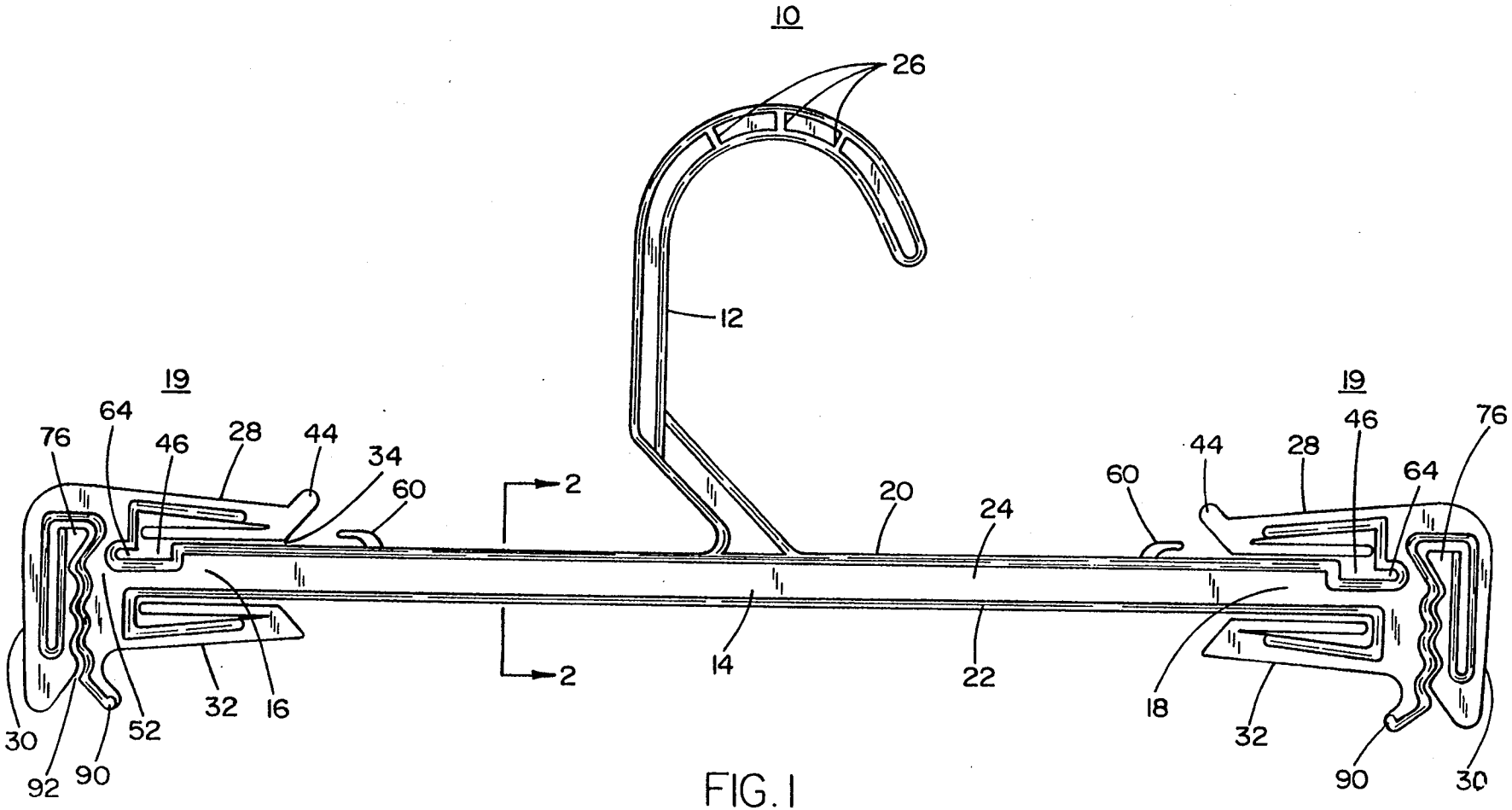
FIG. 1 illustrates a front elevational view of plastic garment hanger pursuant to the inventive concept.

Referring now in detail to the drawings, and particularly, the hanger construction of FIG. 1, there is illustrated a front elevational view of a molded plastic garment hanger 10 having a central hook member 12 which is integrally molded with an elongated hanger body 14, the latter of which includes a pair of coplanar oppositely directed ends 16 and 18 each of said ends terminating with a garment retaining member 19 for suspending one or more garments.

Figure 2:
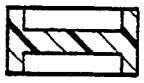
FIG. 2 illustrates a sectional view taken along line 2—2 in FIG. 1.
Figure 3:
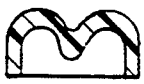
FIG. 3 illustrates a sectional view of an alternative embodiment if taken along line 2—2 in FIG. 1.
Figure 4:
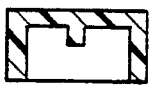
FIG. 4 illustrates a sectional view of an alternative embodiment if taken along line 2—2 in FIG. 1.
Figure 5:
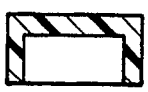
FIG. 5 illustrates a sectional view of an alternative embodiment if taken along line 2—2 in FIG. 1.

As depicted in FIGS. 1 and 2, to maximize strength while using the minimum amount of material, the hanger body 14 and the central hook member 12 are constructed with an I-beam having a first outwardly extending flange 20 and second outwardly extending flange 22 connected by a vertical wall 24. However, in the alternative, the hanger body 14 may be constructed with a curved M-shaped cross-section, an E-shaped cross-section or a U-shaped cross-section, as depicted in FIGS. 3, 4 and 5, respectively, which may improve the strength to weight ratio for particular applications. The hook member 12 can be reinforced by integral ribs 26 which extend forwardly from either side of the vertical wall 24 and tangentially from the first flange 20 to the second (opposite) flange 22 at one or more positions as shown in FIG. 1. The integral ribs 26 add further reinforcement to the hanger form to resist flexing due to the weight of the garment hanging from the hanger of the present invention and assist in maintaining the hanger upright when in use.

It is preferred that each garment retaining member 19 comprises a plurality of garment retaining clips including a first garment retaining clip 28 and a second garment retaining clip 30. The first garment retaining clip 28 is generally horizontally disposed above the body member 14. The second garment retaining clip 30 is generally vertically disposed outwardly from the end 16 or 18. A third garment retaining clip 32, generally horizontally disposed below the hanger body 14, may also be provided on the garment hanger of the present invention. The horizontally disposed garment retaining clips 28 and 32 typically receive shoulder straps from a brassiere, slip or like garment. The vertically disposed garment retaining clip 30 typically receives a waistband from panties, swimsuit bottoms or like garments.

Figure 6:
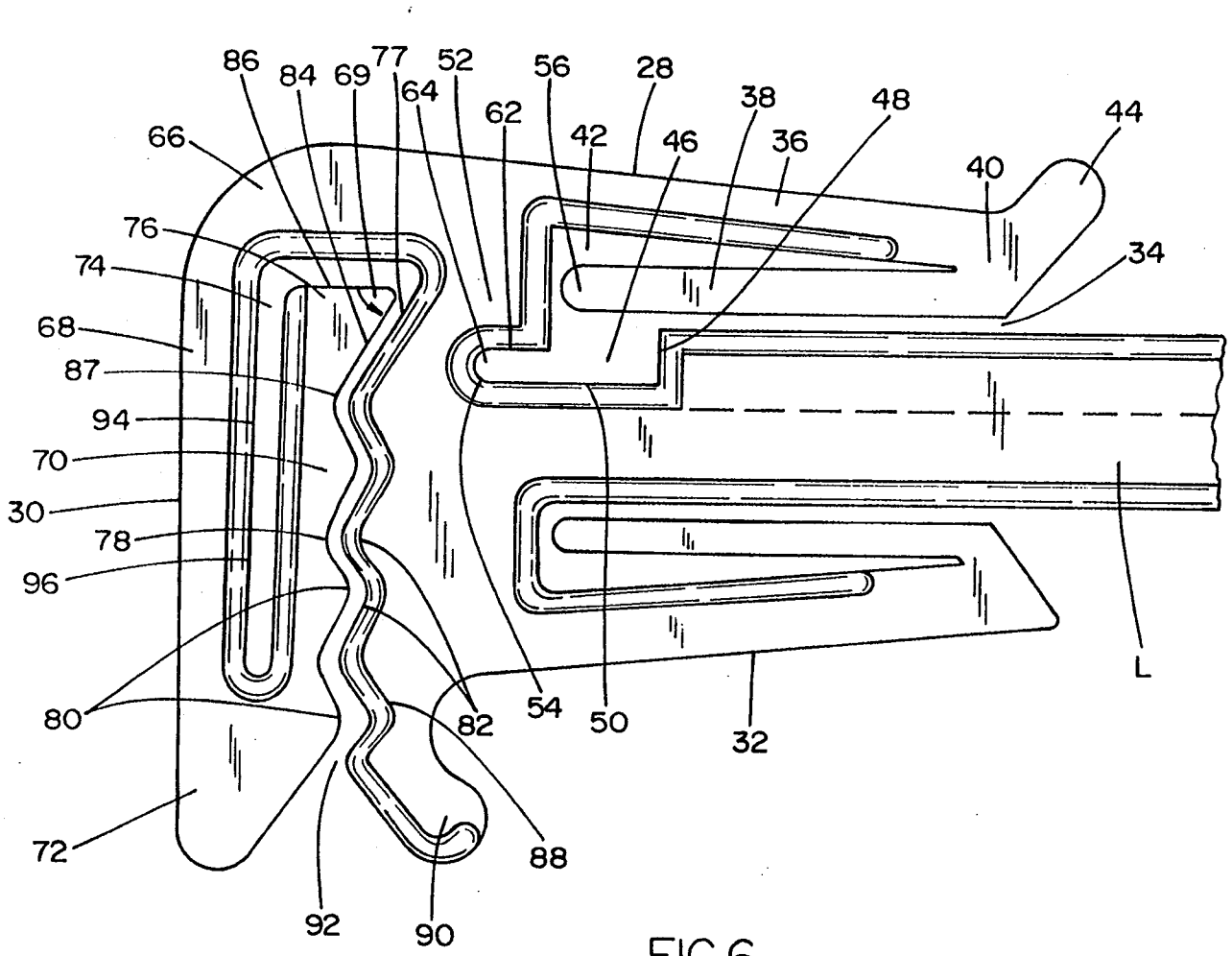
FIG. 6 illustrates an enlarged view of the left end portion of the hanger depicted in FIG. 1.

As illustrated in FIG. 1 and more particularly in FIG. 6, which shows an enlarged elevational view of the left end portion of the hanger depicted in FIG. 1, the first garment retaining clip 28, which is positioned above and adjacent the body member 14, defines a first garment receiving channel 34 therebetween. The first garment receiving clip 28 has a resilient substantially U-shaped configuration comprising a first member 36 and a second member 38 integrally connected in a spaced relationship by a connecting portion 40. When a garment is inserted in the first garment receiving channel 34, the second member 38 deflects into a deflecting area 42 to hold the garment in place. The deflecting area 42 is defined by the first member 36, the second member 38 and the connecting portion 40. Due to the configuration of the first garment retaining clip 28, the second member 38 is moveable in a direction transverse to and from the body member 14 as well in and out of the plane of the hanger body 14. To facilitate the insertion of a garment to be suspended from the hanger the connecting portion 40 is formed with a rounded lip 44 which extends upwardly and inwardly toward the hook member 12.

The first garment receiving channel 34 of the hanger of the present invention is preferably formed with a pocket 46 which is recessed downwardly into the body member 14 of the hanger 10. The pocket 46 is open along an upper portion to the first garment receiving channel 34. The body member defines a first side portion 48 and bottom portion 50 of the pocket 46. A web 52 integrally connected to the body member 14 and the second garment retaining clip 30 defines a second side portion 54 of the pocket 46. The outer end 56 of the second member 38 extends over the pocket.

When a garment or a strap is inserted in the first garment receiving channel 34, the pocket 46 may receive the garment or strap, particularly if the garment or strap is very thin, and resist against its accidental displacement from the first garment receiving clip 28. To provide easy and convenient removal of the garment or strap from the hanger 10, which can then be reused, a smooth corner is provided at the juncture of the body member 14 and upper portion of the first side portion 48 of the pocket 46.

A finger projection 60 may be positioned on the first flange 20 of the body member 14 closer to the hook member 12. The finger projection 60 extends upwardly and inwardly to act as a stop to the garment or strap upon release from the first garment receiving channel 34.

In a particularly preferred form of the invention, as illustrated in FIG. 1 and more clearly illustrated in the enlarged view of the left end portion in FIG. 6, the pocket 46 extends beyond the first garment receiving channel 34 and into the web 52 such that a segment of the upper portion of the pocket 46 is not open but defined by a portion 62 of the web 52 to provide a recess 64. The recess 64 constitutes a portion of the pocket 46 that extends into the web 52.

The second garment retaining clip 30 of the hanger of the present invention extends from an end of the body member 14 and preferably from a top portion 66 of the web 52 which connects the second garment retaining clip 30 to the body member 14 in a resilient, substantially U-shaped configuration. The U-shaped configuration comprises a first finger 68 which extends downwardly from said top portion 66 of the web 52 and a deflecting leg 70 integrally connected in a spaced relationship by a second connecting portion 72. A second garment receiving channel 92 is defined between the deflecting leg 70 and the web 52.

The deflecting leg 70 is spaced inwardly of the first finger 68 to define an second deflecting area 74 therebetween. The deflecting leg 70 has an uppermost portion 76 having a substantially triangular configuration. The uppermost portion 76 begins at or near the center longitudinal axis L of the body member 14. A first side 86 of the triangular portion 76 is parallel to said body member 14 and a second side 84 of the triangular portion 76 is angled downwardly at an acute angle 69 (with respect to the longitudinal axis). A surface 77 of the web 52 on an inward side of the second garment receiving channel 92 is complementary to the second side of the triangular portion and also angled downwardly at an acute angle with respect to the longitudinal axis. It will be noted that second side 84 extends inwardly from its beginning point 87 with respect to a vertical axis of the hanger.

The second side 84 of the triangular portion 76 provides an inward bend in the waistband over the center of the longitudinal axis of the body member 14 to better secure the waistband of the garment. The elastic in the waistband generates a horizontal force vector towards the hook of the hanger when stretched. This horizontal force vector is deflected upwardly by the inward angle (with respect to the vertical axis of the hanger) of the second side 84, thereby urging the waistband upwardly and onto the hanger as the waistband contracts. This feature provides a natural bias to retain the garment on the hanger. Also by gripping the top portion of the stretched waistband at an inward angle the waistband will not be inadvertently dislodged.

Additionally, by distributing the compressive force of the waistband over the entire area of the longitudinal axis the hanger is better able to resist deflection of the ends 16 and 18 of the hanger 10 due to such compressive forces.

In a particularly preferred embodiment, the web 52 and inner surface 78 of the deflecting leg 70 are each formed with a series of complementary rippled protrusions 80, 82. The series of rippled protrusions 80 included on said deflecting leg 70 ends in the uppermost portion 76.

To facilitate insertion of a garment and, particularly, a waistband of a garment, into the second garment receiving channel 92 a lower portion 88 of the web 52 can be formed with a downwardly and inwardly extending second lip 90. The series of complementary rippled protrusions 80, 82 provide additional reinforcement against inadvertent disengagement of a waistband and, particularly, a very thin waistband.

Figure 7:
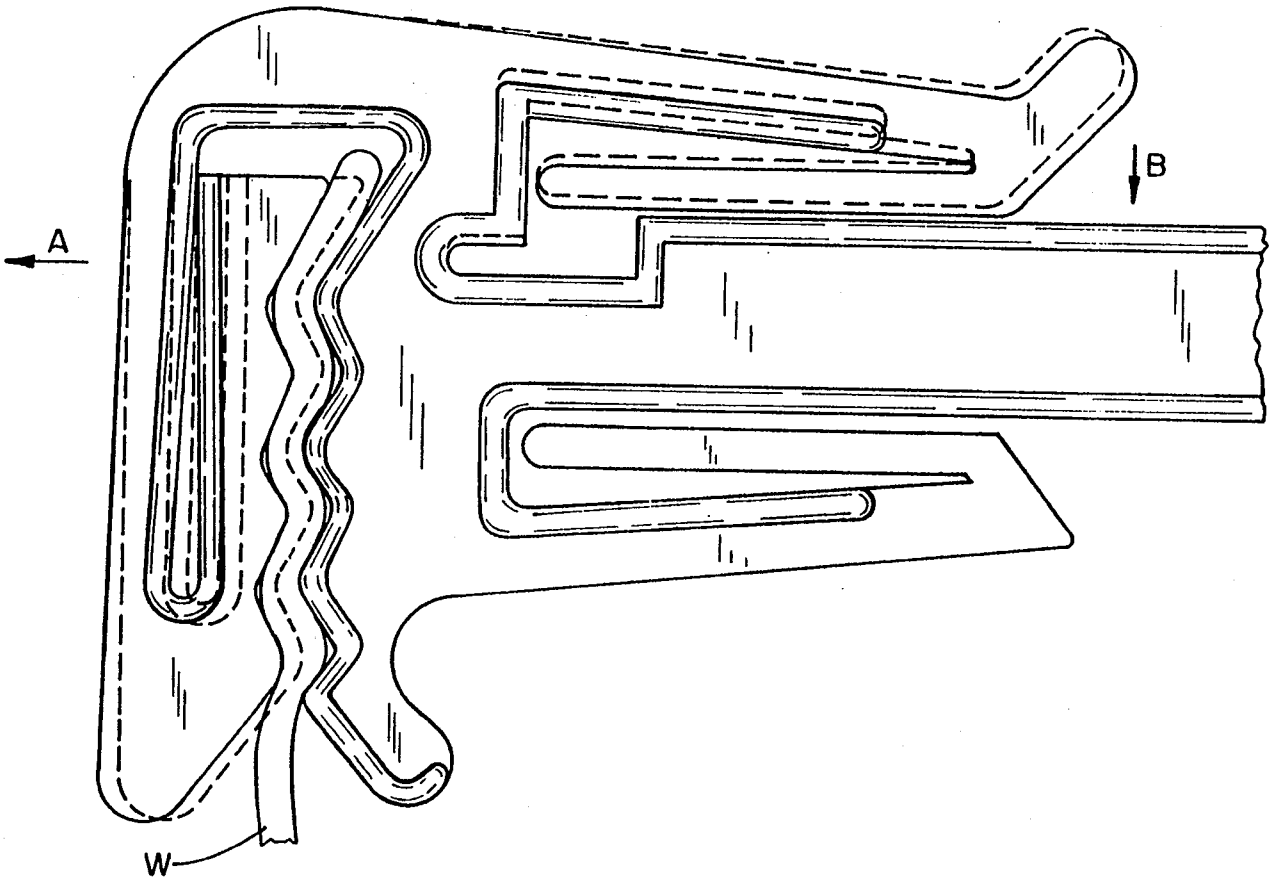
FIG. 7 illustrates the enlarged view of FIG. 3 with a garment inserted in the vertical clip and in phantom line the original positions of the first and second garment retaining clips.

In use, the second side portion 54 of the pocket 46 and web portion 62 may act as a spring. FIG. 7 illustrates the garment retaining member 19 located at end 16 of the body member 14 with a garment W inserted in the second garment retaining clip 30. The original position of the various elements of the garment retaining member 19 are depicted in phantom lines therein. When a garment is inserted in the second garment receiving channel 92 the deflecting leg 70 is pushed outwardly in the direction of arrow A so that a second inner surface 94 of the uppermost portion 76 of the deflecting leg 70 abuts an inner surface 96 of the first finger 68. The abutment causes the first finger 68 of the second garment retaining clip 30 to flex outwardly.

When the first finger 68 of the second garment retaining clip 30 flexes outwardly a stress is placed on the web 52 which causes the entire first garment retaining clip 28 to move in the direction of arrow B that forces the second member 38 to rest on the first flange 20 of the body member 14. The recess 64 is of a suitable dimension to accommodate the extra stress placed on the web 52. To accommodate the extra stress without breakage of either the first or the second garment retaining clips 28 or 30, the portion of the web 52 which defines the second side portion 54 of the pocket 46 acts in the nature of a spring which bends downwardly as depicted in FIG. 7. It will be appreciated that the bottom portion 50, first side portion 48 and second side portion 54 of the pocket 46 may be thickened to reinforce the spring action.

It will be noted that a garment or strap may be inserted into the first garment receiving channel 34 either before or after a garment has been inserted into the second garment receiving channel 92. Even when the second member 38 of the first garment retaining clip 28 is resting on the first flange 20 of the hanger body 14 due to the insertion of a garment in the second garment receiving clip which has caused the deflecting leg 70 to rest against the first finger 68, the resilient nature of the garment receiving clips of the present invention still permits the insertion of a strap by causing the second member 38 to be deflected in deflecting area 42. It is notable, however, that the downward movement of the second member 38 provides additional resistance against the inadvertent dislodging of a garment from the first garment receiving channel 34.

The second side portion 54 also accommodates any stress resulting from the insertion of a thick garment or strap in the first garment receiving channel 34 by bending upwardly if necessary.

Accordingly, the second side portion 54 of the pocket 46 and, particularly, the portion of the pocket 46 referred to herein as the recess 64 enables the distribution of stresses within both the first garment retaining clip 28 and the second garment retaining clip 30 thereby reducing the likelihood of breakage of each during use.

More importantly, the spring action, which accommodates excessive stress, permits the hanger of the present invention to be used not only with thin, flimsy garments but garments of varying thicknesses without the need to obtain additional types of hangers. Thus, the garment engaging clips of the hanger of the present invention are constructed to flex numerous times without danger of breakage but maintain a resilience that provides sufficient resistance to deflection resulting in inadvertent release of the garment clamped therein.

It will be appreciated that the spring action plays a role not only when a garment is inserted in either the first or second garment receiving channels 34,92 but also when a garment is removed from the hanger 10. If the garment or strap clamped by the first garment retaining clip 28 is held in the pocket 46 a smooth corner is provided for convenient removal thereof without breakage of the clip 28.

From the foregoing illustrations it is readily apparent that the present invention is directed to a light-weight molded plastic garment hanger for high volume injection molding. Through its configuration a hanger is produced which can accommodate more stress than other comparable hangers without sacrificing flexibility. Since the hangers of the present invention are less prone to breakage and can be re-used production of such hangers is environmentally advantageous.

The plastic hanger of the present invention can be formed of styrene which provides a clear, virtually transparent hanger for maximum display of intimate apparel garments, such as bras and panties, to be suspended therefrom. In the alternative, the hanger can be molded from polypropylene, preferably H.I. styrene polypropylene; polyvinylchloride; ABS or other suitable thermoplastics and mixtures thereof. For additional reinforcement, K resin can be added to the plastic material.

While there have been shown and described what are considered to be the preferred embodiments of the invention, it will, of course, be understood that various modifications and changes in form or detail can be readily made without departing from the spirit of the invention. It is therefore intended that the invention not be limited to the exact form and detail herein shown and described nor to anything less than the whole of the invention herein disclosed as hereinafter claimed.

I claim:

1. A light-weight, molded, plastic garment hanger comprising:

a hook member;

a body member extending longitudinally from said hook member, said body member defining first and second ends;

a garment retaining member integrally molded with said body member at each of said first and second ends;

wherein said garment retaining member comprises at least a first garment retaining clip, a second garment retaining clip, and a pocket;

said first garment retaining clip positioned adjacent to said body member defining a first garment receiving channel therebetween, said first garment retaining clip having a substantially U-shaped configuration comprising a first member and a second member integrally connected in spaced relation at a connecting portion, whereby said second member deflects into a deflecting area defined by said first member, said second member and said connecting portion, and said connecting portion formed with a rounded lip to facilitate the insertion of a garment to be suspended from said hanger;

said pocket being open along an upper portion to said first garment receiving channel with said pocket defined by said body member on a bottom portion and a first side portion, and by a web integrally connected to said body member on a second side portion; and said second garment retaining clip extending from an end of said body member in a substantially U-shaped configuration including a deflecting leg, with said deflecting leg defining a second garment receiving channel adjacent said body member, said deflecting leg having an uppermost portion having a substantially triangular configuration, wherein said deflecting leg and said web are each formed with a series of complementary rippled protrusions, said uppermost portion beginning at or near the center longitudinal axis of the body member, wherein a first side of said triangular uppermost portion is parallel to said body member and a second side of said triangular uppermost portion is angled downwardly at an acute angle.

2. The hanger according to claim 1, further comprising a finger projection positioned on said body member closer to said hook member, said projection extending upwardly and outwardly.

3. The hanger according to claim 1, wherein a lower portion of said web is formed with a downwardly and inwardly extending rounded lip to facilitate the insertion of garments to be suspended from said second garment retaining clip.

4. The hanger according to claim 1, wherein said pocket extends beyond said first garment receiving channel into said web such that said web defines a segment of said upper portion.

5. The hanger according to claim 1, wherein said second side portion of said pocket defines a recess in said web, said second side portion acting in the nature of a spring.

6. The hanger according to claim 1, wherein the second side of the triangular portion provides an inward bend in a waistband over a center of a longitudinal axis of the body member to better secure the waistband of a garment.

* * * * *